US011444389B2

(12) United States Patent
Chamberland

(10) Patent No.: US 11,444,389 B2
(45) Date of Patent: Sep. 13, 2022

(54) PRINTED CIRCUIT BOARD FOR AN ANTENNA

(71) Applicant: TrueRC Canada Inc., Rouyn-Noranda (CA)

(72) Inventor: Hugo Chamberland, Rouyn-Noranda (CA)

(73) Assignee: TRUERC CANADA INC., Rouyn-Nornda (CA)

( * ) Notice: Subject to any disclaimer, the term of this patent is extended or adjusted under 35 U.S.C. 154(b) by 54 days.

(21) Appl. No.: 17/026,986

(22) Filed: Sep. 21, 2020

(65) Prior Publication Data

US 2021/0036436 A1 Feb. 4, 2021

Related U.S. Application Data

(62) Division of application No. 15/607,639, filed on May 29, 2017, now Pat. No. 10,804,618.

(60) Provisional application No. 62/342,742, filed on May 27, 2016.

(51) Int. Cl.

| | |
|---|---|
| ***H01Q 21/20*** | (2006.01) |
| ***H01Q 9/30*** | (2006.01) |
| ***H01Q 11/08*** | (2006.01) |
| ***H01Q 9/28*** | (2006.01) |
| ***H01Q 9/18*** | (2006.01) |
| ***H01Q 1/36*** | (2006.01) |
| ***H01Q 9/06*** | (2006.01) |
| ***H01Q 1/38*** | (2006.01) |

(52) U.S. Cl.

CPC ..... *H01Q 21/205* (2013.01); *H01Q 1/362* (2013.01); *H01Q 1/38* (2013.01); *H01Q 9/065* (2013.01); *H01Q 9/18* (2013.01); *H01Q 9/285* (2013.01); *H01Q 9/30* (2013.01); *H01Q 11/08* (2013.01)

(58) Field of Classification Search

None

See application file for complete search history.

(56) References Cited

U.S. PATENT DOCUMENTS 5,255,005 A * 10/1993 Terret ..... H01Q 11/08 343/895

5,635,945 A * 6/1997 McConnell ..... H01Q 11/08 343/895

(Continued)

FOREIGN PATENT DOCUMENTS

CN 10492007 A * 10/2014

*Primary Examiner* — Ab Salam Alkassim, Jr.

(74) *Attorney, Agent, or Firm* — Brouillette Legal Inc.; Robert Brouillette

(57) ABSTRACT

A printed circuit board for an antenna comprising at least one antenna bay comprising an input port; a feed network and a radiative component is provided. The feed network has a center node connected to the input port; a printed circuit board (PCB), comprising an active surface having at least two feed micro-strips and a reference surface having at least two first reference micro-strips, the reference surface being opposite to the active surface. The radiative component has at least two dipoles, each of the at least two dipoles being shaped as a helix and being uniformly disposed about an antenna axis, each of the at least two dipoles comprising a dipole fed portion connected to one of the at least two feed micro-strips and a dipole reference portion connected to one of the at least two first reference micro-strips.

20 Claims, 10 Drawing Sheets

(56) References Cited

U.S. PATENT DOCUMENTS

| | | | | |
|---|---|---|---|---|
| 6,133,891 | A * | 10/2000 | Josypenko | H01Q 11/08 343/895 |
| 6,384,798 | B1 * | 5/2002 | Barta | H01Q 11/08 343/895 |
| 6,653,987 | B1 * | 11/2003 | Lamensdorf | H01Q 5/321 343/895 |
| 10,693,242 | B2 * | 6/2020 | Hyjazie | H01Q 11/08 |
| 2005/0017907 | A1 * | 1/2005 | Engargiola | H01P 5/10 343/700 MS |
| 2009/0204372 | A1 | 8/2009 | Johnston et al. | |
| 2013/0210372 | A1 * | 8/2013 | Park | H01Q 21/26 455/73 |
| 2016/0294063 | A1 * | 10/2016 | McGough | H01Q 5/371 |
| 2018/0159233 | A1 * | 6/2018 | Kummetz | H01Q 1/525 |
| 2018/0351246 | A1 * | 12/2018 | Yu | H01Q 5/314 |
| 2020/0335881 | A1 * | 10/2020 | Le | H01Q 1/521 |
| 2021/0234279 | A1 * | 7/2021 | Ye | H01Q 1/362 |
| 2021/0336351 | A1 * | 10/2021 | Zhang | H01Q 5/50 |
| 2021/0376481 | A1 * | 12/2021 | Zhang | H01Q 21/0006 |

* cited by examiner (A)

(B)

PRINTED CIRCUIT BOARD FOR AN ANTENNA

CROSS-REFERENCE TO RELATED APPLICATIONS

The present patent application is a divisional application of the U.S. Provisional patent application Ser. No. 15/607,639 entitled "COMPACT POLARIZED OMNIDIRECTIONAL HELICAL ANTENNA" filed at the United States Patent and Trademark Office on May 29, 2017, and claims the benefit of priority of U.S. Provisional Patent Application No. 62/342,742, entitled "COMPACT CIRCULAR POLARIZED OMNIDIRECTIONAL HELICAL ANTENNA", and filed at the United States Patent and Trademark Office on May 27, 2016, the content of which is incorporated herein by reference.

FIELD OF THE INVENTION

The present invention relates generally to radio frequency (RF) electromagnetic signal broadcasting systems. More particularly, the present invention relates to printed circuit boards or other substrates for antenna, typically for unmanned vehicle telemetry and/or video broadcasting or other applications where weight and/or space are of concern.

BACKGROUND OF THE INVENTION

Circular polarized antennas have been adopted by UAV/UAS hobbyists and professionals for their multi-path rejection properties and their immunity to polarization losses. However, the commonly used circular polarized designs are relatively big versus their linear counterpart and fragile when made light enough for aircraft purpose.

Newly adopted rules also limit the weight of unmanned aircraft and have pushed forward the appearance of ever smaller/lighter aircraft. Even at frequency of 5.8 GHz, circularly polarized antennas often are a substantial part of the vehicle. The common designs consist of multiples wires or thin metal sheets bent in lobes, assembled in a floral like shape (See FIG. 11A). Such designs are costly to fabricate and have tolerances errors.

There is thus a need for a new circular polarized antenna particular adapted to unmanned vehicle telemetry, such as drones and/or video broadcasting or other applications where weight and/or space is a concern.

SUMMARY OF THE INVENTION

The shortcomings of the prior art may be generally mitigated by a compact circular polarized omnidirectional helical antenna providing smaller and lighter circular polarized antennas.

A printed circuit board for the manufacture of a compact polarized omnidirectional helical antenna is described herein. The antenna may be fabricated from lightweight printed circuit board (PCB). Using the PCBs in fabrication of the antenna may be cheaper and have higher predictability, thus leading to smaller fabrication errors compared to the antennas made with wires.

The printed circuit board (PCB) for an antenna may comprise an active surface having one or more feed micro-strips; and a reference surface having a plurality of reference micro-strips, the reference surface being opposite to the active surface, wherein the feed micro-strips and the reference micro-strips are operatively connected to a plurality of dipoles, each of the plurality of dipoles being shaped as a helix and being uniformly disposed about an antenna axis.

In another aspect of the invention, the antenna axis may be a central axis of the antenna and wherein the PCB comprises a center node connected to the feed micro-strips and the reference micro-strips. The PCB may further comprise a plurality of dipole feed nodes connected to the feed micro-strips and the reference micro-strips. The plurality of dipole feed nodes may further be located at the circumferential extremity of the active surface and the reference surface.

In yet another aspect of the invention, all of the plurality of the feed micro-strips and the reference micro-strips may have the same length. In another aspect, each of the feed micro-strips are being tapered, being narrower at the center node than at the feed node; and each of the reference micro-strips are being tapered, being wider at the center node than at the feed node.

In a further aspect of the invention, the PCB may further comprise a plurality of second reference micro-strips located on the reference surface, the plurality of second reference micro-strips connecting the center node to each of a plurality of dipole reference nodes, the plurality of second reference micro-strips each mirroring one of the first reference micro-strips and each being symmetric relative to an axis stretching between the center node and one of the dipole reference nodes.

In accordance with at least one embodiment, there is provided an antenna comprising: at least one antenna bay comprising an input port; a feed network, the feed network comprising a center node connected to the input port; a printed circuit board (PCB) comprising: an active surface comprising at least two feed micro-strips; a reference surface comprising at least two reference micro-strips, the reference surface being opposite to the active surface; a radiative component, the radiative component comprising: at least two dipoles, each of the at least two dipoles being shaped as a helix and being uniformly disposed about an axis of the antenna, each of the at least two dipoles comprising: a dipole feeded portion connected to one of the at least two feed micro-strips; a dipole reference portion connected to one of the at least two reference micro-strips.

The at least two dipoles may be equidistant from the antenna axis. All of the at least two feed micro-strips may have an equal length. All of the at least two reference micro-strips may have an equal length.

The antenna may further comprise at least two dipole feed nodes at the operative connection of the feed micro-strips and the dipole, each of the dipole feed nodes being proximal to an edge of the first PCB, the at least two dipole feed nodes being uniformly distributed along the edge of the first PCB.

The antenna may further comprise at least two dipole reference nodes at the operative connection of the reference micro-strips and the dipole, each of the at least two dipole reference nodes being proximal to the edge of the first PCB, the dipole reference nodes being uniformly distributed along the second circumference.

The at least two dipole feed nodes may be on a first circumference of the PCB and the at least two dipole reference nodes may be on a second circumference of the PCB. The diameter of the first circumference may be equal to the diameter of the second circumference.

The shape of the reference micro-strip may be the same as the shape of the feed micro-strip.

The width of the feed micro-strip may be larger at the feed node than at the center node and the width of at least some of the reference micro-strip being narrower at the reference node than at the center node.

The width of each reference micro-strip at the reference node may be approximately equal to the width of the feed micro-strip at the feed node.

The antenna may further comprise a plurality of second reference micro-strips located on the reference surface, each second reference micro-strip connecting the central node to each of the plurality of dipole feed nodes, each of the second reference micro-strip mirroring one of the first reference micro-strip.

At least some of the reference micro-strips may be parallel to one of the plurality of feed micro-strips.

Each of the second reference micro-strip may be symmetric relative to an axis stretching between the reference port and one of the reference nodes.

The at least two dipoles may be printed on a second PCB, the second PCB being flexible and adapted to form a helical conformation of the at least two dipoles.

In at least one embodiment, the antenna may further comprise a second antenna bay, wherein each antenna bays are oriented on the antenna axis and wherein reference nodes of corresponding dipoles in the first and the second antenna bays are aligned with reference to the antenna axis.

The antenna may further comprise a radome enclosing at least a portion of the antenna.

The dielectric constant of the first PCB may be at least 4.

In at least one embodiment, the input port may comprise an inner conductor and an outer conductor.

In accordance with another embodiment, there is provided an antenna comprising an antenna bay, the antenna bay comprising: a primary radiator, a plurality of parasitic dipoles, each of the parasitic dipoles being shaped as a helix with reference to the primary radiator axis.

The plurality of parasitic dipoles may be uniformly distributed with azimuth about an axis of the primary radiator.

The primary radiator may be a dipole. The primary radiator may be a monopole antenna.

The antenna may further comprise a dipole with operatives to prevent transmission lines induced imbalance (balun).

The parasitic dipoles may be printed on a flexible PCB, the flexible PCB being deformable as a helical conformation of the respective parasitic dipoles thereof.

The antenna may further comprise a radome at least partially enclosing the antenna.

The helical parasitic dipoles may be arranged as to convert linear radiations from a pre-existing linear polarized dipole or monopole antenna into substantially circular polarized radiations.

The parasitic dipoles may further comprise operatives to hold, maintain or fix a pre-existing dipole or monopole antenna substantially at its center.

In accordance with another embodiment, a printed circuit board (PCB) for an antenna is provided. The PCB includes an active surface having one or more feed micro-strips; and a reference surface having a plurality of reference micro-strips, the reference surface being opposite to the active surface, wherein the feed micro-strips and the reference micro-strips are operatively connected to a plurality of dipoles, each of the dipoles being shaped as a helix and being uniformly disposed about an antenna axis.

The antenna axis may be the central axis of the antenna, the PCB may comprise a center node connected to the feed micro-strips and the reference micro-strips.

All of the plurality of the feed micro-strips and the reference micro-strips may have the same length.

Each feed micro-strip may be tapered, being narrower at the center node; and each reference micro-strip may be tapered, being wider at the center node.

The PCB may further comprise a plurality of second reference micro-strips located on the reference surface, the second reference micro-strips connecting the reference node to each of the plurality of dipole reference nodes, the second reference micro-strip mirroring one of the first reference micro-strip and being symmetric relative to an axis stretching between the reference port and one of the reference nodes.

In accordance with another embodiment, a radiative component for an antenna is provided. The radiative component for the antenna includes at least two dipoles, each of the two dipoles being dipole micro-strips located on a substrate, so that when the substrate is deformed, the at least two dipoles are shaped as a helix and uniformly disposed about an antenna axis. The at least two dipoles may comprise: a dipole feeded portion configured to be connected to one of a plurality of feed micro-strips and a dipole reference portion configured to be connected to at least one of the reference micro-strips.

Advantageously, the antenna according to the present invention may occupy approximately 20% of the volume of the commonly used designs.

The antenna as described herein may be used for broadcasting radio frequency electromagnetic signal.

Other and further aspects and advantages of the present invention will be obvious upon an understanding of the illustrative embodiments about to be described or will be indicated in the appended claims, and various advantages not referred to herein will occur to one skilled in the art upon employment of the invention in practice.

DESCRIPTION OF THE DRAWINGS

The above and other aspects, features and advantages of the invention will become more readily apparent from the following description, reference being made to the accompanying drawings in which.

DETAILED DESCRIPTION OF THE PREFERRED EMBODIMENT

A novel compact polarized omnidirectional helical antenna will be described hereinafter. Although the invention is described in terms of specific illustrative embodiments, it is to be understood that the embodiments described herein are by way of example only and that the scope of the invention is not intended to be limited thereby.

Helix shape (26 at FIG. 1) as used herein generally means helix or almost helix shape about an axis specified herein, i.e. having a constant or approximately constant angle with the axis specified herein.

A single-feed circularly polarized omnidirectional helical antenna is disclosed herein. Due to the implementation as described herein, the antenna may be both compact and lightweight. Such antenna may be used for unmanned aircrafts, such as drones, for unmanned vehicle telemetry and/or video broadcasting. The antenna may also be used in other applications where weight and/or space of the antenna are of concern.

Advantageously, the antenna fabricated according to the present invention may occupy approximately 20% of the volume of the commonly used designs.

Figure 1:
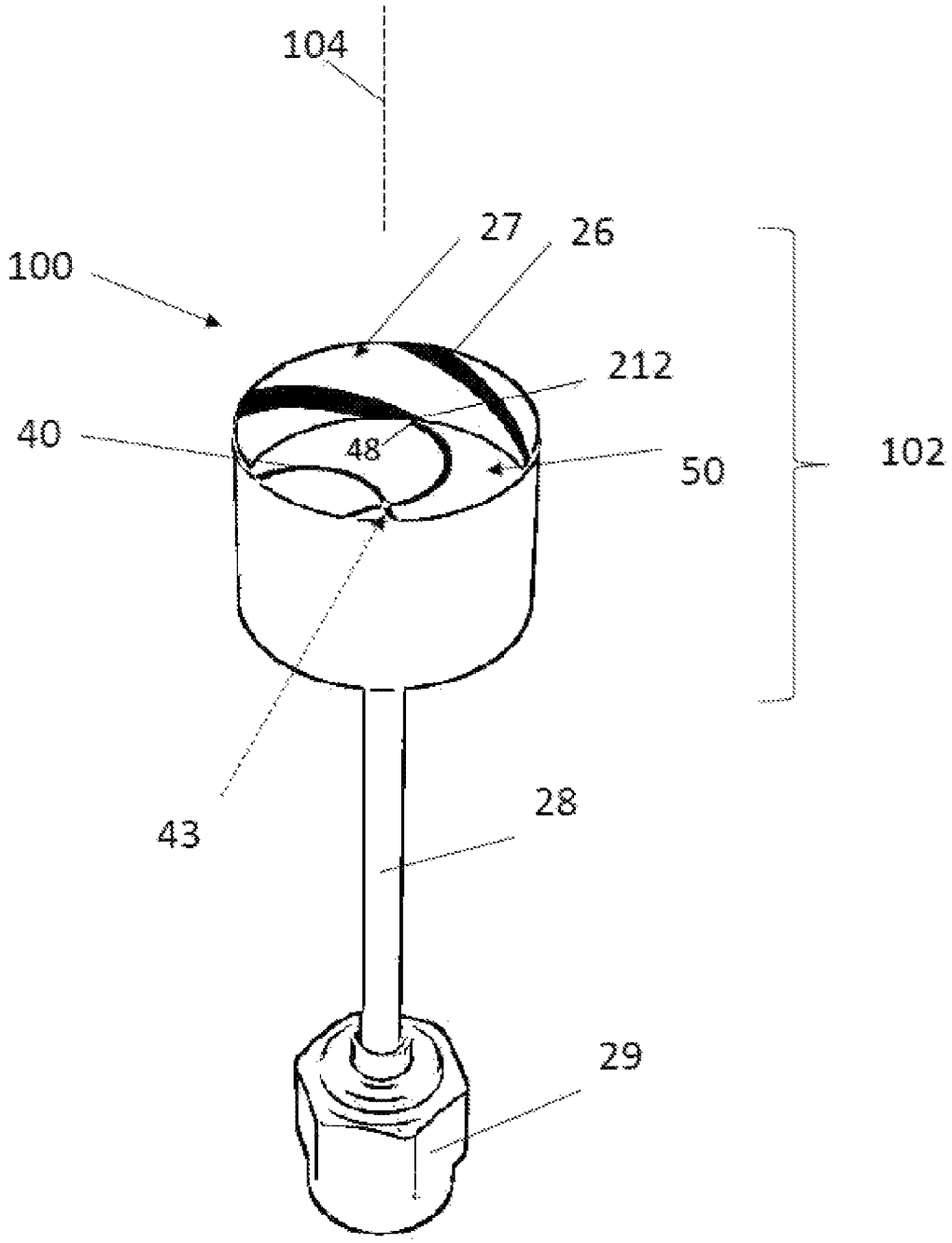
FIG. 1 is a perspective top view of an embodiment of the antenna according to the principles of the present invention.

Referring now to FIG. 1, an antenna 100 according to a preferred embodiment of the present invention is shown. The antenna 100 comprises at least one antenna bay 102. Each antenna bay 102 comprises a feed network 50 and a first radiative component 27. The feed network 50 generally comprises micro-strips 40. The first radiative component 27 typically comprises at least two dipoles 26. In a preferred embodiment, the feed network 50 is operatively connected to the first radiative component 27 at a junction 212.

The antenna 100 further comprises an input port 43. In a preferred embodiment, the input port 43 is coaxial input port having an inner conductor and an outer conductor (not shown at Figures). The outer conductor may serve as a reference potential.

Still referring to FIG. 1, the antenna 100 is adapted to be connected to cable 28. In a preferred embodiment, the cable 28 is typical coax cable 28 connected to a SMA (Sub Miniature version A) connector 29. Understandably, any known mean or connector for connecting the antenna 100 may be used without departing from the principles of the present invention.

In at least one embodiment, a lightweight printed circuit board (PCB) may be used for manufacturing the antenna bay 102. The antenna bay 102 generally comprises a power distribution and matching network 50. In a preferred embodiment, the matching network 50 may be located on a generally circular PCB comprising a micro-strips manifold, an input port and at least two micro-strip arms (also referred herein as "micro-strip").

Figure 8:
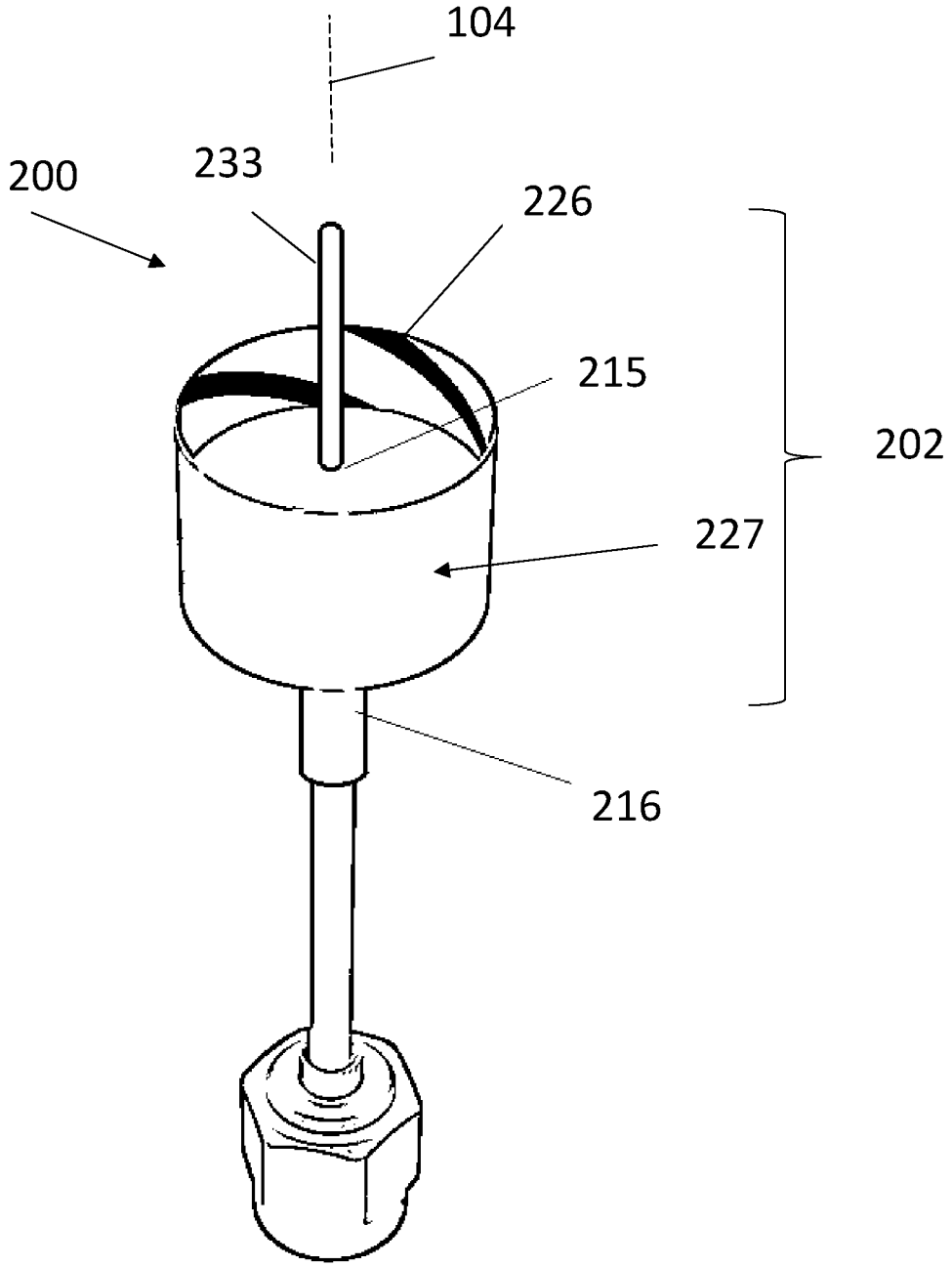
FIG. 8 is a perspective top view of an embodiment of the antenna according to the principles of the present invention.

In a preferred embodiment, the antenna 100 comprises one or more bays 102 of helical dipole radiators 26. The helical dipole radiators 26 are generally excited using a manifold of micro-strips as feeding/matching network 50. Alternatively, the bay 202 of helical dipoles 226 may be used as parasitic radiator of a common dipole antenna 233, effectively converting the common dipole antenna 233 into a circularly polarized omnidirectional helical antenna 200, as shown at FIG. 8.

Referring again to FIG. 1, in at least one embodiment, the power distribution and matching network (together referred to herein as "feed network 50" or "micro-strips network 50") may consist of a generally circular or round PCB 21 comprising micro-strips (manifold), an input port and at least two micro-strip arms 40. At the end of each micro-strip arm 40, helical dipoles 26 may be axially wound in reference to the axis 104 of the antenna 100.

In a preferred embodiment, the length of each micro-strip arm 40 is 90 electrical degrees.

As an example, the antenna 100 may comprise four dipoles 26, each dipole 26 having a helical orientation and having an approximate fourfold rotational symmetry with reference to a common antenna axis 104.

Figure 2:
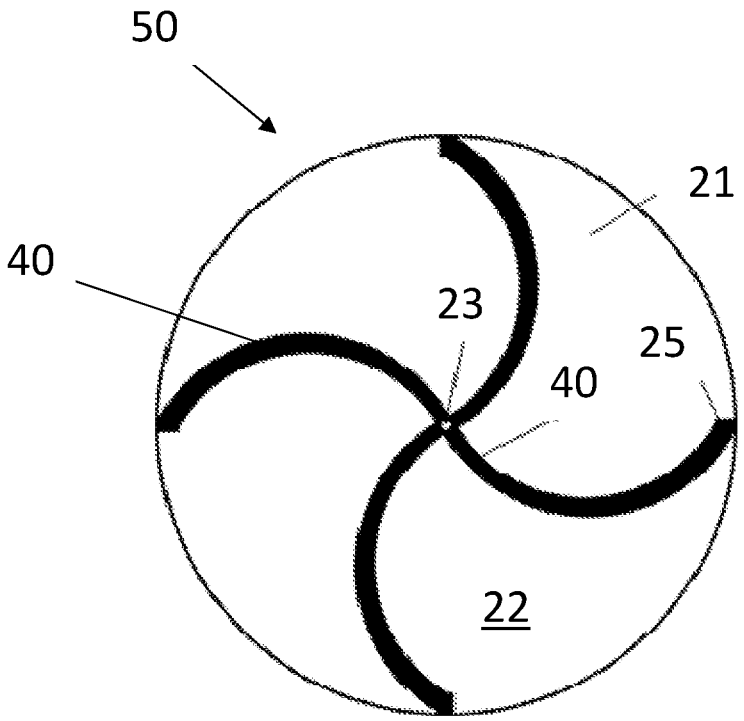
FIG. 2 is the top view of a micro-strips network (active surface) on a first PCB according to a preferred embodiment of the present invention.

Now referring to FIG. 2, an embodiment of a PCB 21 comprising a micro-strips network 50 is shown. In such an embodiment, the first PCB 21 comprises an active plane 22 (also called herein as an "active surface") of the micro-strips network 50. The active plane 22 is shaped in order to achieve the desired length within dipoles arrangement. In at least one embodiment, a central node 23 is connected to the input port 43.

Figure 3A:
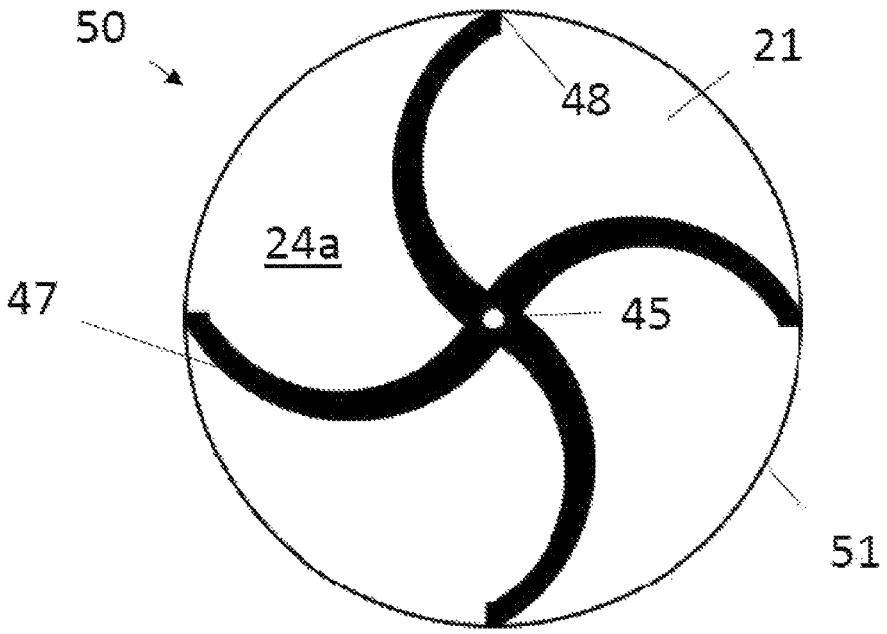
FIG. 3A is the bottom view of the micro-strips network (reference surface) on the first PCB according to the principles of the present invention.

Now referring to FIG. 3A, the bottom surface of an exemplary PCB 21 comprising a reference plane 24*a* (also called herein as "reference surface" of PCB) of the micro-strips network 50 is shown. In such an exemplary PCB 21, the micro-strips network 50 is shaped as two generally "S" shape crossing about their center.

Figure 3B:
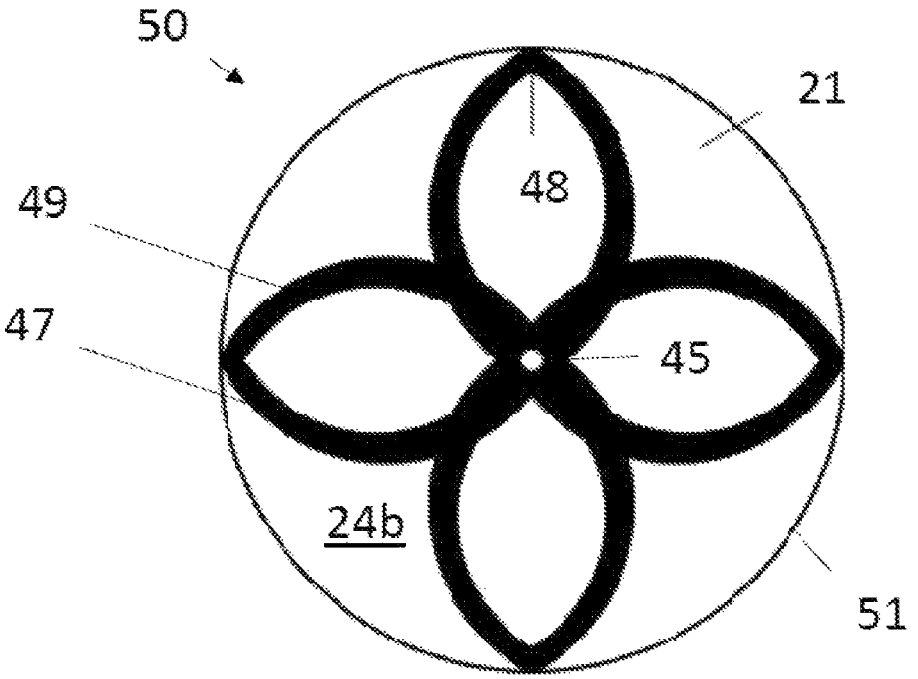
FIG. 3B is the bottom view of the micro-strips network (reference surface) on the first PCB according to the principles of the present invention.

Now referring to FIG. 3B, an another exemplary embodiment of a micro-strips network 50 being shaped as two generally "S" shape crossing about their center and two generally inverted "S" shape crossing about their center. Understandably, any other design having micro-strips allowing a connection with the periphery may be used without departing from the principles of the present invention.

In at least one embodiment, the micro-strips, 47 and 49 on FIGS. 3A and 3B may have a form of an arc or any other form of detour in order to accommodate the electrical length needed for matching of the dipoles to the feed line within the space between the dipoles.

Still referring to FIG. 3B, in some embodiments, the bottom (reference) micro-strip 47 on the reference surface 24*b* may be doubled by doubling micro-strips 49 (also referred herein as "second reference micro-strips") to be substantially symmetric in regard to an axis drawn between the dipole reference nodes 48 and the reference port 45. Each second reference micro-strip 49 may connect the central node 45 to each of the plurality of dipole reference nodes 48, each of the second reference micro-strip 49 mirroring one of the first reference micro-strip 47 and being symmetric relative to the axis stretching between the reference port 45 and one of the reference nodes 48.

Preferably, the width of the micro-strips 40, 47 and 49 may be adjusted following the rules of the art. As an example, the width of the micro-strips 40, 47 and 49 may be adjusted in order to achieve proper impedance match from the helical dipoles 26 (see FIGS. 4 and 5) to the feed line 28.

In at least one embodiment, the reference plane 24*a*, 24*b* of the micro-strip network 50 may be substantially symmetric and/or tapering into a parallel strip. In a preferred embodiment, at the reference port 45, the reference micro-strips 47, 49 is about three times wider than the feed micro-strips 40, while at the feed nodes 25, the width of the feed micro-strip 40 and the width of the reference micro-strips 47, 49 are about the same.

In yet another embodiment, the micro-strips 40 may have double tapered shape. The double tapered shape generally aims at providing a smooth transition between the unbalanced coax feed line 28 and the balanced helical dipoles feed 33. The double tapered shape may consist of gradually widening the top (active) trace (also referred herein as "feed micro-strip") and a gradually narrowing bottom (reference) trace (also referred herein as "reference micro-strip"). In such an embodiment, when the reference micro-strips 47, 49 are wider, the feed micro-strips 40 are narrower. Such configuration generally aims at conserving the impedance relatively constant throughout the length of the micro-strips.

As an example, each feed micro-strip 40 may be tapered, as shown at FIG. 2. In such an embodiment, the width of the micro-strip 40 is generally larger about the feed node 25 compared to the center node 23.

Figure 3C:
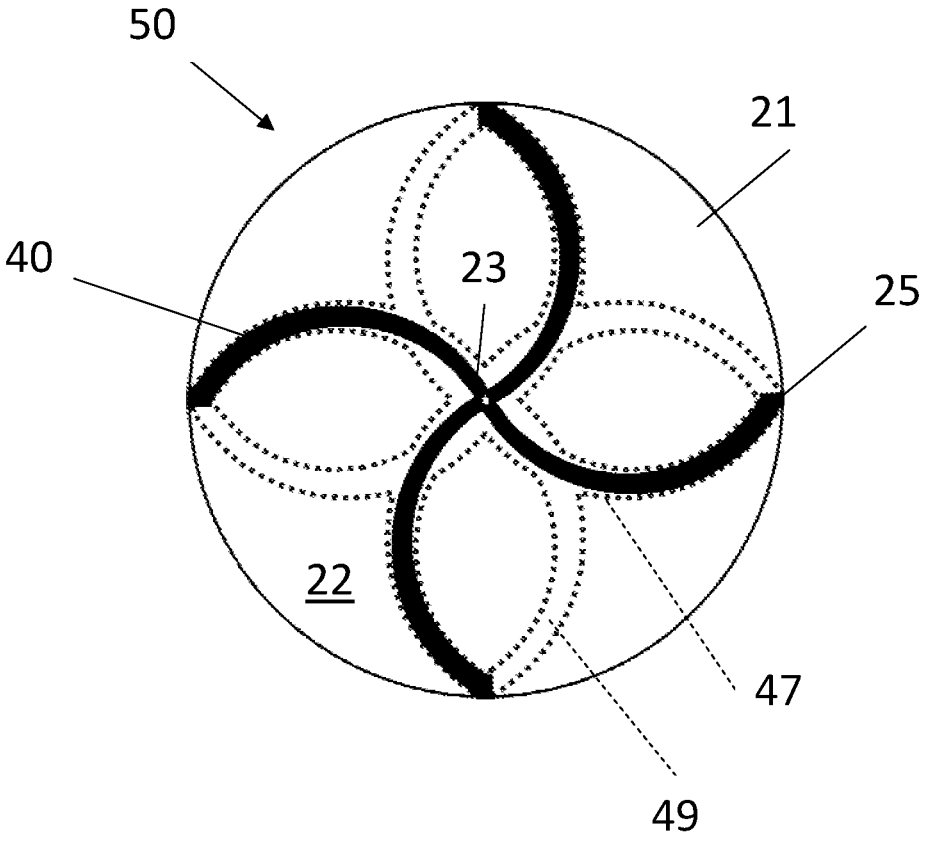
FIG. 3C is a top see-through view of an example embodiment of the micro-strips network with tapered micro-strips.

The micro-strip 47 of the reference surface may also be tapered. Referring to FIGS. 3A and 3B, the width of the tapered micro-strip 47 it is smaller at the reference node 48 compared with the width of the micro-strip 47 at the reference port 45. The width of each tapered reference micro-strip 47 at the reference node 48 are approximately equal to the width of the feed micro-strip at the feed node 25. In such an embodiment, the width of the top and bottom trace (micro-strips 40, 47, 49) may be generally equal at the feed point 25 of the dipole. Being equal, the micro-strips 40, 47, 49 become a substantially parallel strips balanced transmission line. Referring now to FIG. 3C, shown therein is a see-through view of such example embodiment of the feed network 50 comprising tapered micro-strips 40, 47, 49. While the feed micro-strips are located on the feed surface 22, the reference micro-strips 47, 49 are located on the reference surface. Tapering of the micro-strips 40, 47, 49 relevant to each other are shown.

One of the advantages of such arrangement is that the unbalanced current flowing on the outside of a coaxial transmission line are minimized, safeguarding the antenna's circular properties.

In a preferred embodiment, the micro-strips 40 may have an impedance adjusted to match the impedance of the dipoles 26 (for example, four dipoles) to the feed line 28 (shown, for example, at FIG. 1 described herein). In a typical embodiment, the input port preferably consists of a hole or aperture 23 in a first PCB 21 that may permit soldering of the conducting cable or connector, such as a center portion of a coaxial cable to the active plane 22.

In at least one embodiment, at least two dipole feed nodes 25 are located at the operative connection 212 of the feed micro-strips 40 to the dipole 26. On yet another embodiment, the dipole feed nodes 25 are located on a same circumference (also referred herein as first or feed circumference) and the at least two dipole feed nodes 25 are uniformly distributed along the first circumference. Such first circumference is preferably proximal to an edge of the first PCB 21.

In at least one embodiment, at least two dipole reference nodes 48 are located at the operative connection of the first reference micro-strips 47 to the dipole 26. In yet another embodiment, each of the at least two of dipole reference nodes 48 are located on the same circumference (also referred herein as second or reference circumference). The dipole reference nodes 48 are uniformly distributed along the second circumference. Such second circumference is preferably proximal to an edge of the first PCB 21.

In a preferred embodiment, the PCB 21 is shaped to allow the feed nodes 25 to be located on the first circumference and to allow the reference nodes 48 to be located on the second circumference. In a preferred embodiment, the first and the second circumferences have an equal radius. In least one embodiment, the first radiative component 27 may be printed on a flexible PCB. In such an embodiment, the shape of the first radiative component 27 is generally deformed. The deformed shaped is, in a preferred embodiment, a helical conformation of the dipoles 26. In a preferred embodiment, the dipoles 26 are generally shaped as a rectangular sheet of flexible PCB. The dipoles 26 are wound in a generally cylindrical shape around the matching network 50 for an entire PCB material construction. Wounded flexible dipoles 26 are generally suitable for mass production. Understandably, other shapes and configuration may be used without departing from the principles of the present invention.

Figure 4:
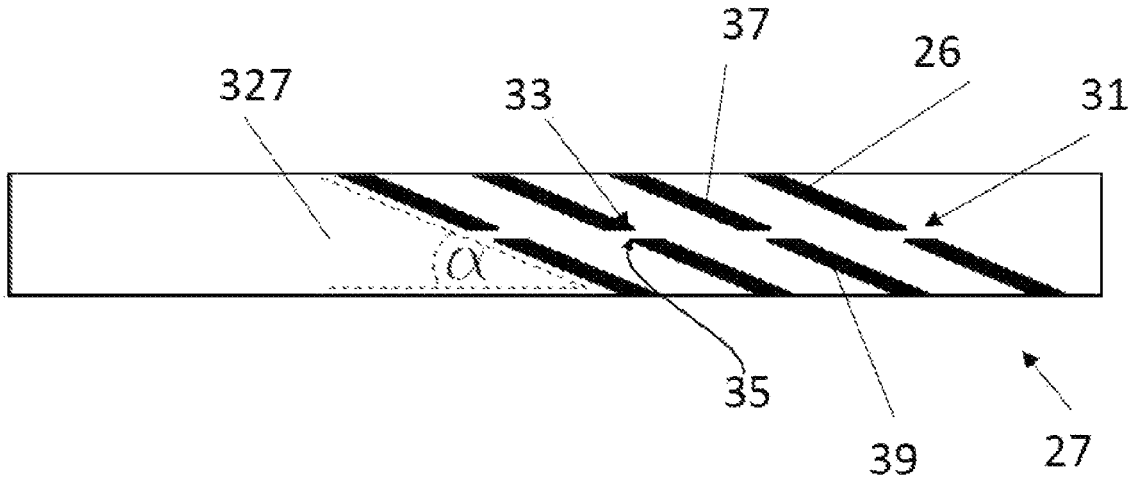
FIG. 4 is a side view of the dipoles traced on a first radiative component in its flat state according to a preferred embodiment of the present invention.

Now referring to FIG. 4, an exemplary embodiment of a first radiative component 27 is shown as implemented on a second PCB 327. As an example, referring to FIG. 4, the first radiative component 27 is shown unfolded. Now referring to FIG. 5, the first radiative component 27 is folded at one side to connect to another side to form a generally cylindrical shape.

In some embodiments, the first radiative component 27 is made of any flexible material adapted to receive dipoles 26, such as PCB material or any other material comprising dipoles 26. In a preferred embodiment, the material used for substrate 327 of the first radiative component 27 is polyimide. The substrate 327 of the first radiative component 27 may also be made of any other type of flexible material adapted to be rolled or folded as a cylinder. For example, the substrate 327 may be made of plastic, glass fiber, Polytetrafluoroethylene, e.g. Teflon.

Now referring to FIG. 4, the first radiative component 27 may comprise printed dipoles 26 (also referred herein as "dipole elements"). In some embodiments, each of the dipoles 26 comprises a fed portion 37 and a reference portion 39. The fed portion 37 and the reference portion 39 are separated with a gap 31. The gap is generally defined by a reference node 35 and feed node 33. For example, the gap 31 may be approximately the same width as the width of the first PCB 21 (e.g. distance between a feed surface and a reference surface).

Still referring to FIG. 4, in a preferred embodiment, the angle $\alpha$ is within a range of about 17° to about 23°. The angle $\alpha$ may generally vary based on the diameter of the feeding PCB 21. For example, if the diameter of the PCB is $\lambda/4$, the angle $\alpha$ may be 22.5°, where $\lambda$ is the wavelength. For example, if diameter of the PCB is $\lambda/2$, the angle $\alpha$ may be 45°, if diameter of the PCB is $\lambda/8$, the angle $\alpha$ may be 11°.

In yet another embodiment, the first PCB 21 has a dielectric constant of more than 3. In some other embodiments, the first PCB 21 may have a dielectric constant of 4 or more. Preferably, the first PCB 21 has a dielectric constant of about 4.5.

Figure 5:
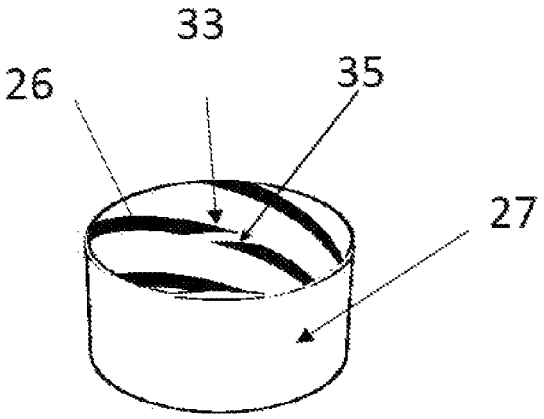
FIG. 5 is a perspective view of the first radiative component in accordance with the principles of the present invention.

In a preferred embodiment, the first radiative component 27 is flexible enough to be rolled as a cylinder shape. Referring to FIG. 5, an example embodiment of the first radiative component 27 being rolled in a cylinder shape is shown. In at least one embodiment, the internal diameter of such cylinder may be substantially equal to the diameter of the matching network 50 of the first PCB 21.

In a preferred embodiment, the internal diameter of the rolled cylinder of the first radiative component 27 is adapted to receive the first PCB 21. The first radiative component 27, when rolled in a cylindrical shape, may be adapted to receive the dipoles elements 26 in their rolled form. In a preferred embodiment, the dipole elements 26 are rolled in a way to face the interior of the cylinder.

Figure 6:
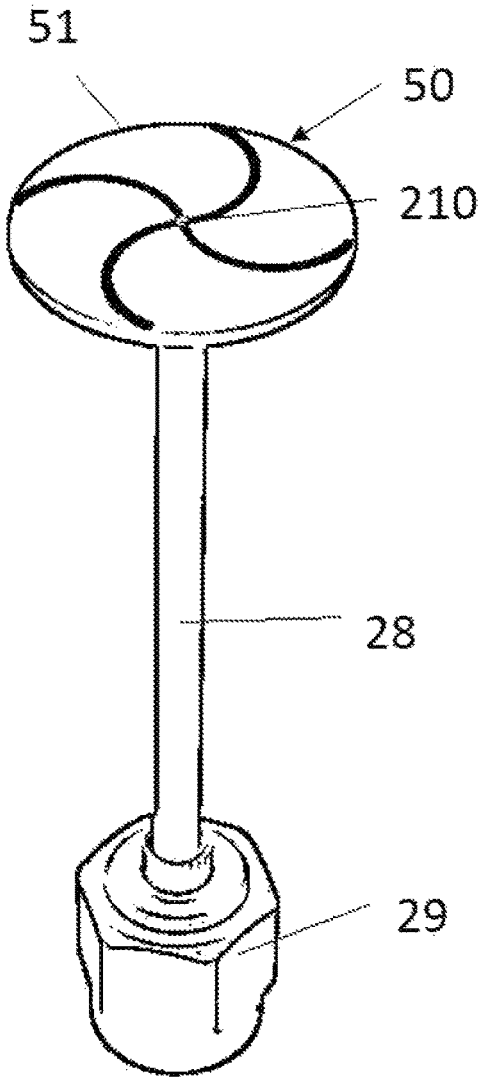
FIG. 6 is a perspective top view of the network attached to a common coax cable with connector according to the principles of the present invention.

Now referring to FIG. 6, an embodiment of an antenna 100 shown without the radiative component 27 is presented. The matching network 50 is installed on a common coax cable 28 comprising a SMA (Sub Miniature version A) connector 29. The center 210 of the surface is adapted to receive the center portion of the coaxial cable 28 to create a connection with the network 50. The inner portion of the coaxial cable 28 may be soldered or welded to the active plane 22 to provide an electric connection.

Figure 7:
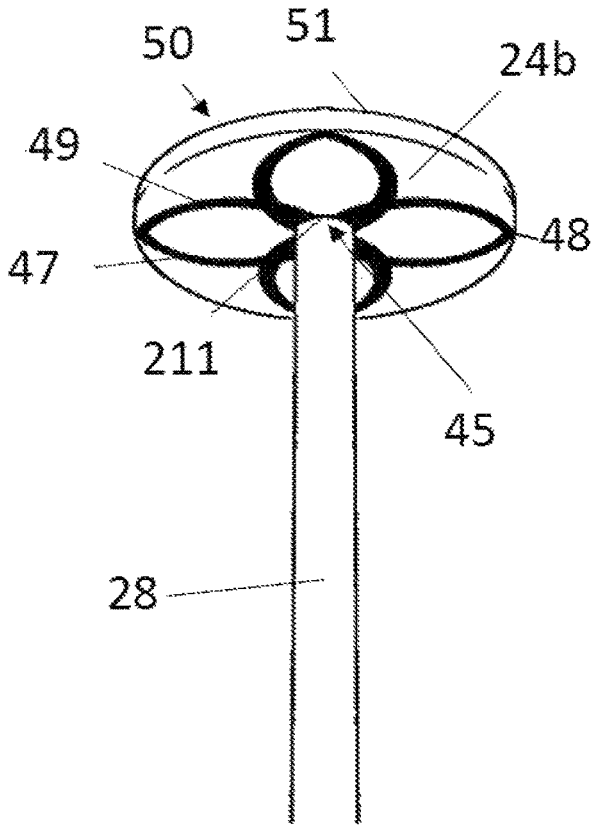
FIG. 7 is a perspective bottom view of the network with common coax cable according the principles of the present invention.

Now referring to FIG. 7, an embodiment of the antenna 100 without the radiative component 27 is shown. The outer portion of the coax cable 28 is preferably attached to the reference surface 24*b*. The attachment 211 may be any type of attachment mean known in the art, such as soldering or welding.

Referring now to FIGS. 1-7, in a preferred embodiment, the feed points 33, 35 of the dipole 27 may connect to the bottom and top traces 40, 47, 49 of the network 50 on the edge 51 of the first PCB 21. The connection of the feed points 33, 35 to the network 50 may be a solder joint or a weld joint to connect the junction 212 to the micro-strips 40 and the dipoles elements 26.

Now referring to FIG. 8, a further embodiment of the antenna 200 is shown. In such an embodiment, the antenna 200 comprises a second radiative component 227 and a bushing 215. The bushing 215 may be made of plastic or any non-conductible material, such as non-metallic material. The bushing 215 generally aims at attaching the primary dipole radiator 233 to the surface of the second radiative component 227, preferably being attached within the center of the cylindrical radiator 227. The second radiative component 227 may be made of a PCB.

The antenna 200 further comprises a set of helical shaped dipoles 226. The helical shaped dipoles 226 are preferably shorted in single continuous conductors, thus aiming at being substantially parasitic radiating elements. In a preferred embodiment, the continuous conductors may be placed around a common dipole 233 or a monopole primary radiator. The antenna 200 may further comprise a dipole with operatives 216 to prevent transmission lines induced imbalance (balun).

The antenna 200 aims at limiting the use of parallel-strips network but having a taller dipole primary radiator 227.

The helical shaped parasitic dipoles arrangement may also be used as singular unit to retrofit existing common dipole antennas, converting them from substantially linear radiation mode to substantially circular radiation mode.

Figure 9:
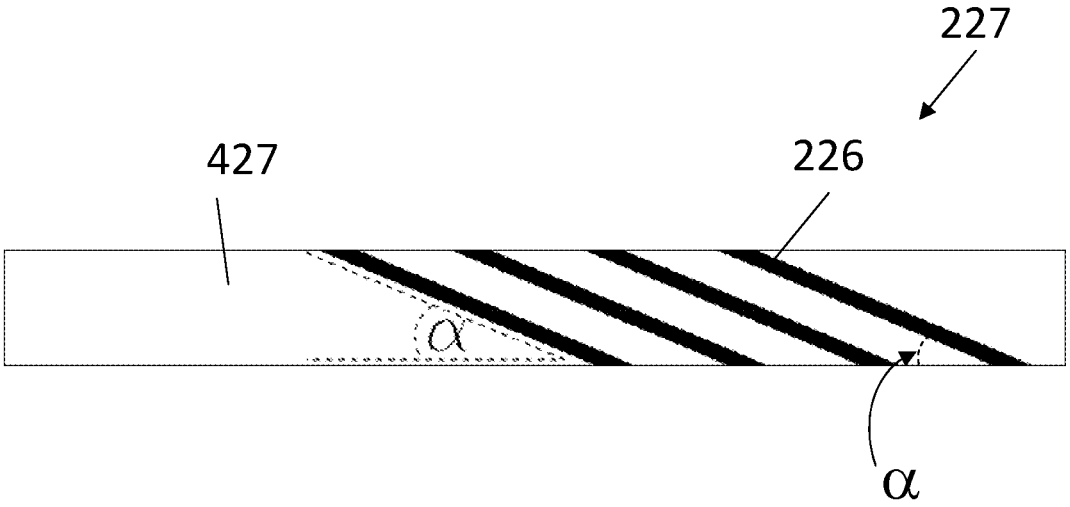
FIG. 9 is a side view of the dipoles traced on a second radiative component in its flat state according to the principles of the present invention.

Referring now to FIG. 9, an alternate embodiment of a flexible strip 227 comprising a plurality of parasitic dipoles 226 to be rolled into the radiator is shown. The flexible strip 227 may be made of PCB.

Figure 10:
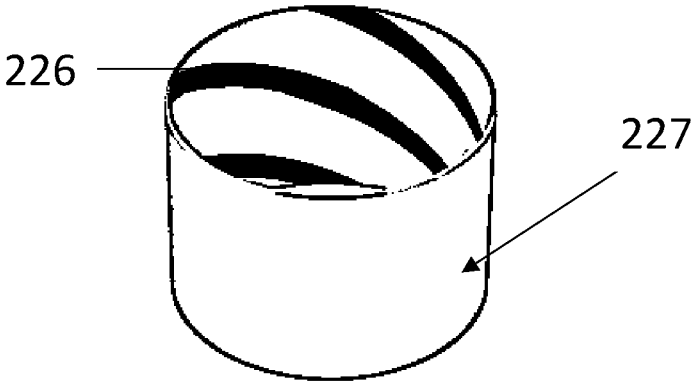
FIG. 10 is a perspective view of the second radiative component according to the principles of the present invention.

Now referring to FIG. 10, in a preferred embodiment, the flexible strip 227 is made of flexible material and may be shaped as to be rolled or folded as a cylinder. In at least one embodiment, the internal diameter of the formed cylinder may be substantially equal to the diameter needed to provide circular polarisation. The antenna 200 may have a similar layout of the helical dipoles 226 as antenna 100, but with indirect feeding of the dipoles 226 from a centrally placed dipole 233 or monopole antenna. It should be noted that such an embodiment allows that the circular polarization direction of antenna 200 be reversed from the antenna 100 due to the 180 degree delay created by the parasitic elements.

The radiative component 227 may be made of any flexible material allowing dipoles 226, such as PCB material. In a preferred embodiment, the material used for substrate 427 of the radiative component 227 is polyimide. The substrate 427 of the flexible strip 227 may also be made of any other material flexible enough to be rolled into a cylinder. For example, the substrate 427 may be made of plastic, glass fiber, Polytetrafluoroethylene, e.g. Teflon.

Still referring to FIG. 10, the flexible strip 227 formed as a cylindrical shape comprising the parasitic dipoles elements 226 in their rolled form is shown.

Once formed, the antenna 100, 200 may be placed in a molded plastic, a radome or other durable and RF transparent material, generally aiming at increasing protection of the antenna 100, 200.

In accordance with another embodiment, the antenna 100, 200 may further comprise a second antenna bay 102, 202. The first and the second antenna bays 102, 202 may be oriented on a common antenna axis 104, wherein radiative components of the respective antenna bays 102, 202 may be substantially identical in structure. The reference nodes of corresponding dipoles 26, 226 in respective antenna bays 102, 202 may be aligned with reference to the antenna axis 104.

The antenna 100, 200 may further comprises a radome (not shown). The radome may enclose the other components of antenna 100, 200 at least partially for protecting the antenna 100, 200.

The antenna 100, 200 may be used for broadcasting radio frequency electromagnetic signal. In a preferred embodiment, the antenna 100, 200 is a single-feed circularly polarized omnidirectional helical antenna. The broadcasting of radio frequency electromagnetic signal may be used by, but not limited to, unmanned vehicle telemetry (such as drone) and/or video broadcasting or other applications where weight and/or space is of concern.

Figure 11A:
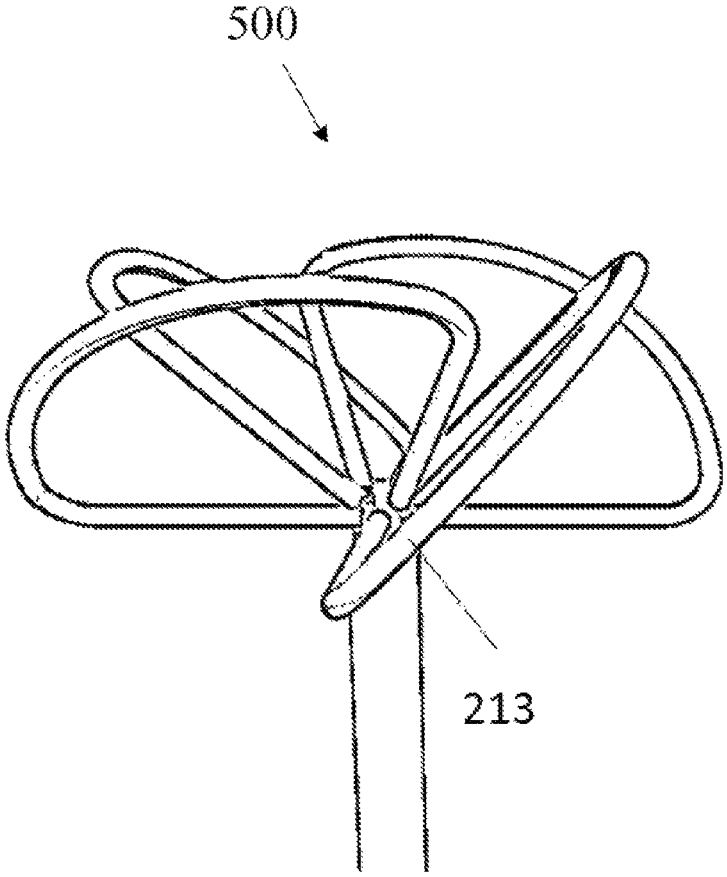
PRIOR ART Fig. 11A
FIG. 11A is a perspective view of a prior art antenna.
Figure 11B:
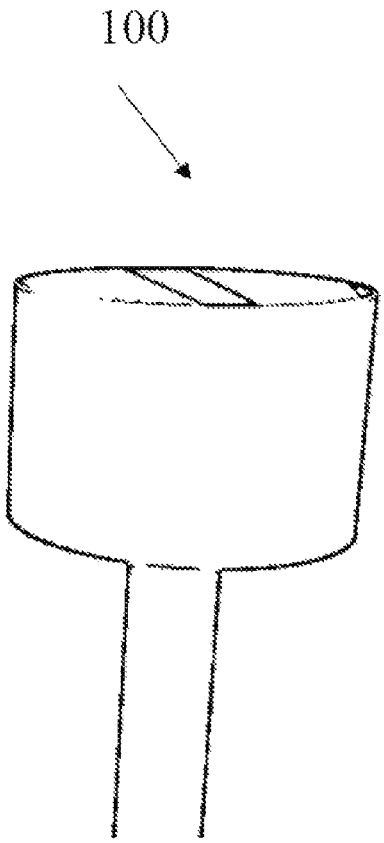
FIG. 11B is a perspective view of the antenna in accordance with the principles of the present invention.

Now referring to FIG. 11, a preferred embodiment of the present invention 214 is shown aside with an exemplary prior art 213 antenna. Typically, the prior art antennas 213 occupy a volume of a demi-sphere having a radius of ¼ λ, where λ (lambda) is the wavelength. For example, if λ is 23 cm for a demi-sphere, the value of (¼*λ) provides radius (r) of 5.75 cm. As the volume of a sphere having a radius of 5.75 cm is about 800 $cm^2$ (the volume of a sphere being ⅔*π*r), the volume of a demi-sphere of a typical prior art antenna 213 is 400 $cm^2$. Advantageously, the antenna 100 as described herein may take about 20% of volume of the prior art's antennas. For example, a cylinder of the radiative component 27, 227 of the antennae 100 may have a radius of ⅛*λ and height of ⅛*λ. For example, the prior art antenna for 1.2 GHz for λ=23 cm has a general volume of approximately 400 $cm^3$ while an antenna 100 according to the principles of the present invention having a frequency of 1.2 GHz would have a volume of approximately 75 $cm^3$.

Figure 12:
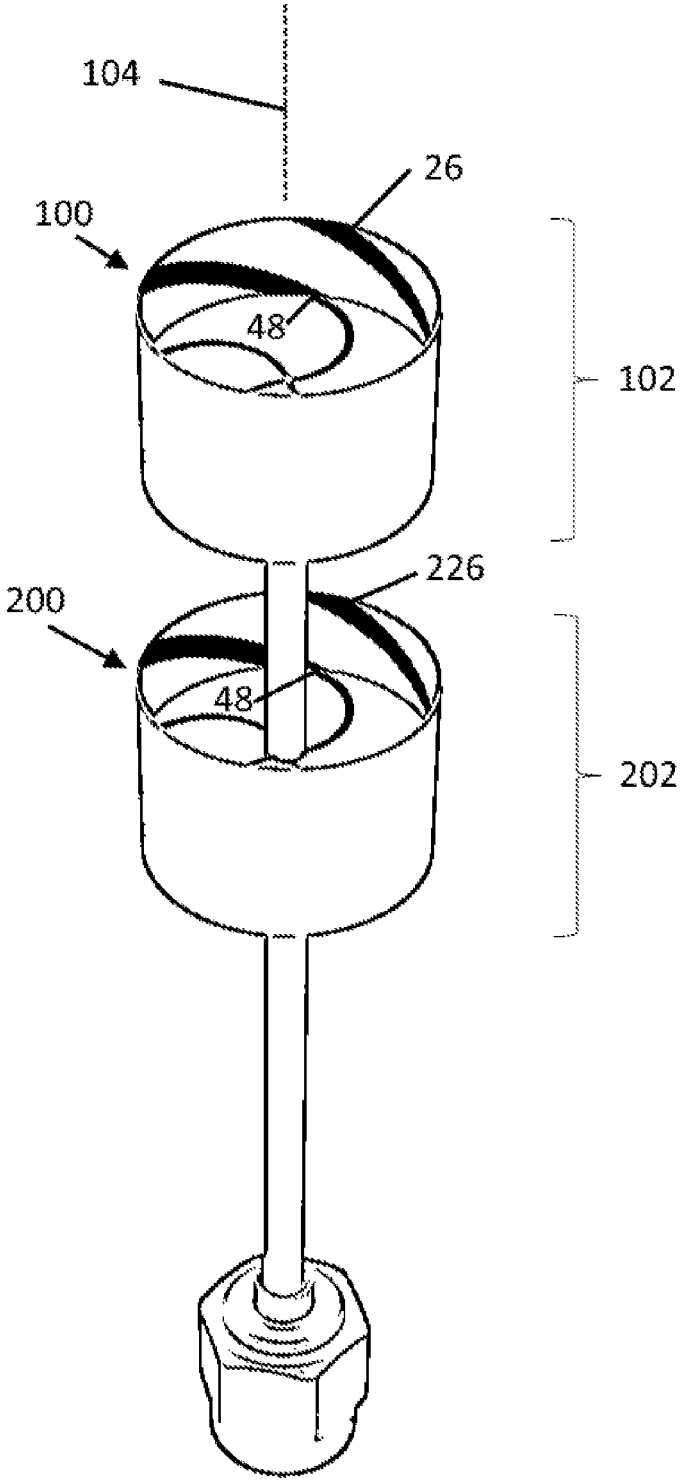
FIG. 12 is a perspective top view of an embodiment comprising two antennas according to the principles of the present invention.

Referring now to FIG. 12, the antenna comprises two antenna bays 102, 202. The antenna bays 102, 202 share the same antenna axis 104 and are in accordance with the embodiments presented above.

While illustrative and presently preferred embodiments of the invention have been described in detail herein above, it is to be understood that the inventive concepts may be otherwise variously embodied and employed and that the appended claims are intended to be construed to include such variations except insofar as limited by the prior art.

The invention claimed is:

1. A planar transformer-type converter between a balanced and an unbalanced signal (balun) for a grounded antenna connected to a feedline and having a radiating element, the planar balun comprising:

a planar transmission-line transformer, the transformer comprising:

an input port and a reference port, each port being connectable to the feedline of the antenna;

at least two feed nodes and at least two reference nodes, each of the feed nodes being connected to the input port through one feed microstrip, and each of the reference nodes being connected to the reference port through a pair of reference microstrips, each of the feed and reference microstrips having a nonlinear path and being connectable to the radiating element, the feed and reference microstrips being on opposite sides of a substrate.

2. The planar balun of claim 1, wherein the input port and the reference port are coupled to a coaxial feedline.

3. The planar balun of claim 1, the feed microstrip being tapered and narrower at a center node, the center node being connected to the microstrip and to the pair of reference microstrips; and each reference microstrips being tapered and wider at the center node.

4. The planar balun of claim 1, wherein the planar balun comprises more than one feed nonlinear paths between the input port and the feed nodes.

5. The planar balun of claim 1, wherein the planar balun comprises more than one reference nonlinear paths between the reference port and the reference nodes.

6. The planar balun of claim 1, wherein the feed microstrip and the reference microstrips are disposed radially equilaterally.

7. The planar balun of claim 1, the substrate having an active side and a reference side, the active side comprising the feed microstrip and the reference side comprising the pair of reference microstrips.

8. The planar balun of claim 7, the substrate being a PCB.

9. The planar balun of claim 1, all of the feed microstrip and the pair of reference microstrips having the same length.

10. The planar balun of claim 1, the planar balun further comprising an active surface having the feed microstrip and a reference surface having the pair of reference microstrips, the reference surface being opposite to the active surface.

11. The planar balun of claim 10, the pair of reference microstrips connecting a central node of the reference surface to the radiating element.

12. The planar balun of claim 11, a second of the pair of reference microstrips mirroring a first of the pair of reference microstrips.

13. The planar balun of claim 12, the second reference microstrip being symmetric to the first reference microstrip relative to an axis stretching between the reference port and one of the reference nodes.

14. The planar balun of claim 1, the nonlinear path comprising an arc.

15. The planar balun of claim 1, the nonlinear path being curved.

16. The planar balun of claim 1, the feed microstrip being S-shaped and the pair of reference microstrips being shaped as two opposed "S", the feed microstrip mirroring one of the pair of reference microstrips.

17. A planar transformer-type converter between a balanced and an unbalanced signal (planar balun) for a grounded antenna connected to a feedline and having a radiating element, the planar balun comprising:

a planar transmission-line transformer, the transformer comprising:

an input port and a reference port, each port being connectable to the feedline of the antenna;

at least two feed nodes and at least two reference nodes, the at least two feed nodes being connected to the input port through one feed microstrip and the at least two reference nodes being connected to the reference port through a pair of reference microstrips, each of the feed and reference microstrips having a nonlinear path and being connectable to the radiating element, the feed and reference microstrips being separated by a gap between the input port and the reference port.

18. The planar balun of claim 17, the gap being filled with an element made of non-conductible material.

19. The planar balun of claim 17, the planar balun further comprising an active surface having the feed microstrip and a reference surface having the pair of reference microstrips, the reference surface being opposite to the active surface, the pair of reference microstrips connecting a central node of the reference surface to the radiating element.

20. The planar balun of claim 19, a second of the pair of reference microstrips mirroring a first of the pair of reference microstrips.

* * * * *